US006619426B2

(12) United States Patent
Minami et al.

(10) Patent No.: US 6,619,426 B2
(45) Date of Patent: Sep. 16, 2003

(54) EXHAUST SILENCER

(75) Inventors: Kazutaka Minami, Saitama (JP); Satoru Nojiri, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 163 days.

(21) Appl. No.: 09/946,380

(22) Filed: Sep. 6, 2001

(65) Prior Publication Data

US 2002/0029928 A1 Mar. 14, 2002

(30) Foreign Application Priority Data

Sep. 8, 2000 (JP) ..... 2000-273521

(51) Int. Cl.[7] ..... F01N 1/02
(52) U.S. Cl. ..... 181/251
(58) Field of Search ..... 181/251, 249, 181/250, 252, 253, 254, 255, 256, 257

(56) References Cited

U.S. PATENT DOCUMENTS 4,073,361 A * 2/1978 Murota et al. ..... 181/228
4,124,091 A * 11/1978 Mizusawa ..... 181/231
4,368,799 A * 1/1983 Wagner ..... 181/255
6,241,044 B1 * 6/2001 Nishiyama et al. ..... 181/272
6,531,091 B2 * 3/2003 Miyamato et al. ..... 420/418

FOREIGN PATENT DOCUMENTS

JP A 777041 3/1995

* cited by examiner

*Primary Examiner*—Kimberly Lockett
(74) *Attorney, Agent, or Firm*—Birch, Stewart, Kolasch & Birch, LLP

(57) ABSTRACT

An exhaust silencer allows for elongation of an inner cylinder relative to an outer cylinder. The exhaust silencer is assembled and constructed in such a way as to simplify the assembly process. A rear end portion of the outer cylinder is blocked with a stepped disc. A rear end portion of the inner cylinder is slidably mounted on a step portion of the stepped disc. A fuse portion is provided at the rear end portion of the inner cylinder and is welded to the step portion of the stepped disc. The fuse portion temporarily tacks the stepped disc to the inner cylinder during a temporary assembly stage. The fuse portion is so constructed that it will fracture as a result of thermal expansion of the inner cylinder, when exhaust gas flows through the exhaust silencer.

20 Claims, 9 Drawing Sheets

(a)

(b)

EXHAUST SILENCER

BACKGROUND OF THE INVENTION

1. Field of the Invention

The present invention relates to an exhaust silencer or muffler configured to permit relative elongation of an inner cylinder relative to an outer cylinder.

2. Description of the Relevant Art

Exhaust silencers are known in the background art. For example, in an exhaust silencer disclosed in JP-A No. H7-77041, entitled "muffler for motorcycle," respective front end portions of an outer cylinder and an inner cylinder are integrated with each other, and respective rear end portions of them are configured to be blocked by a tail plate (hereinafter, referred to as "stepped disc").

The stepped disc is provided with a small diameter portion (hereinafter, referred to as "step portion") loosely fitted in the rear end portion of the inner cylinder, and a large diameter portion (hereinafter, referred to as "enlarged diameter portion") tightly fitted in the rear end portion of the outer cylinder. The rear end portions of the outer cylinder and the inner cylinder can be blocked by the stepped disc, by loosely fitting the small diameter portion in the rear end portion of the inner cylinder, and also tightly fitting the large diameter portion in the rear end portion of the outer cylinder.

When the inner cylinder is thermally expanded by heat from exhaust gas, the rear end portion of the inner cylinder slides relative to the step portion, since the step portion in the rear end portion of the inner cylinder is loosely fitted. Thus, the relative elongation of the inner cylinder relative to the outer cylinder is permitted.

When the stepped disc is assembled to the inner cylinder and the outer cylinder, first the step portion of the stepped disc is loosely fitted in the rear end portion of the inner cylinder. Next, the rear end portion of the outer portion is tightly fitted on the enlarged diameter portion of the stepped disc. Thus, when the rear end portion of the outer cylinder is fitted on the enlarged diameter portion of the stepped disc, the stepped disc is liable to be deviate from a regular location.

When the stepped disc is deviated from the regular location, the assembly work to fit the enlarged diameter portion in an opening of the rear end portion of the outer cylinder is difficult. Thus, the assembly process is complicated and time consuming.

In order to eliminate the deviation of the stepped disc from the regular location, the stepped disc may be fixed by using a fixing jig. However, using the fixing jig takes time. The fixing jig must be mounted and dismounted on to, and off of, the stepped disc. Therefore, the fixing jig does not enhance the assembly process from the standpoint of time and complexity.

Thus, there exists a need in the background art to provide an exhaust silencer permitting a relative elongation of an inner cylinder to an outer cylinder, which is easier to assemble.

SUMMARY OF THE INVENTION

To achieve the above object, an exhaust silencer according to the present invention includes one end portion of an outer cylinder sandwiching glass wool between the outer cylinder and an inner cylinder, is coupled to one end portion of the inner cylinder having a plurality of expansion chambers inside thereof. The relative elongation of the inner cylinder to the outer cylinder is permitted by blocking the other end portion of the outer cylinder with a stepped disc, and by slidably mounting the other end portion of the inner cylinder on a step portion of the stepped disc.

The structure of the exhaust silencer of the present invention is characterized in that a fuse portion, which is fractured when a prescribed force is presented thereto, is provided at the other end portion of the inner cylinder. The structure of the exhaust silencer is further characterized in that the fuse portion is welded to the step portion of the stepped disc, or to a wall surface constituting the step portion, to temporarily tack the stepped disc to the inner cylinder during a temporary assembly stage. Further, the inner cylinder is separated from the stepped disc by the fracturing of the fuse portion caused by thermal expansion of the inner cylinder, when exhaust gas flows through the inner cylinder.

The fuse portion has a construction capable of temporarily tacking the stepped disc to the inner cylinder by welding the fuse portion to the step portion of the stepped disc, or to the wall surface constituting the step portion. Therefore, when performing assembly work, such as welding of the rear end portion of the outer cylinder to the stepped disc, the deviation of the stepped disc from a regular location is prevented.

Further, the fuse portion is fractured to separate the inner cylinder from the stepped disc, when thermal expansion of the inner cylinder occurs. Thus, the rear end portion of the inner cylinder can slide relative to the step portion of the stepped disc. Therefore, the elongation of the inner cylinder relative to the outer cylinder is permitted.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 1:
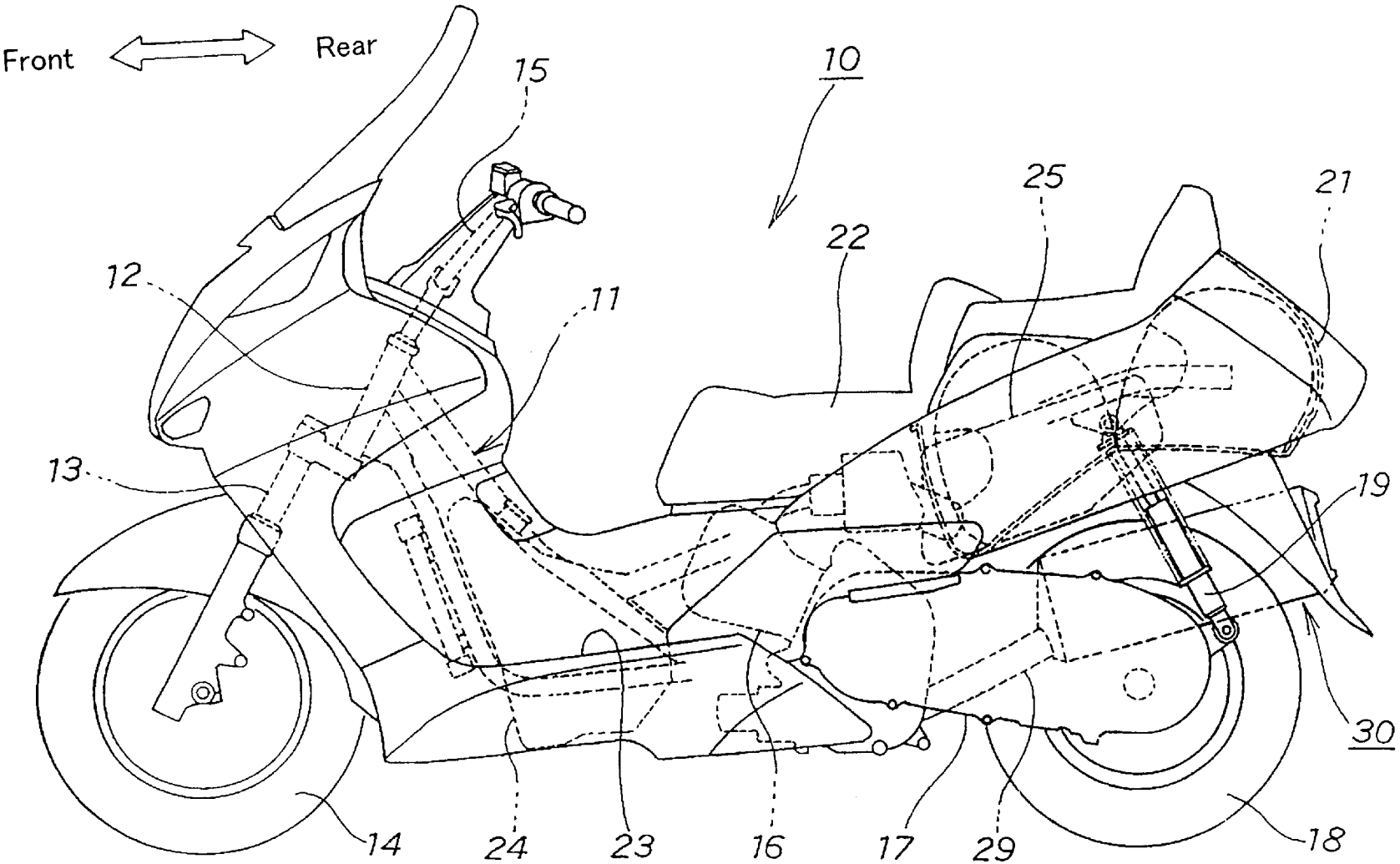
FIG. 1 is a side view illustrating a motorcycle provided with an exhaust silencer, according to the present invention.

In FIG. 1, a motorcycle 10, such as a scooter type motorcycle, includes a body frame 11. A front fork 13 is mounted on a head pipe 12 of the body frame 11. A front wheel 14 is mounted on the front fork 13, and a handlebar 15 is connected to the front fork 13.

An engine 16 is mounted on a rear portion of the body frame 11. A power transmission mechanism 17 is vertically swingably mounted on the engine 16. A rear wheel 18 is mounted on the power transmission mechanism 17. A rear cushion 19 is suspended with the rear end portion of the power transmission mechanism 17 from the body frame 11.

A storage box 21 is mounted on a rear upper side of the body frame 11. A seat 22 is arranged above the storage box 21. The seat may be opened or closed to gain access to the storage box 21.

An exhaust pipe 29 extends rearwardly from the engine 14. An exhaust silencer 30 is mounted on the rear portion of the exhaust pipe 29. The motorcycle 10 also includes a floor step 23, a fuel tank 24, and an air cleaner 25.

Figure 2:
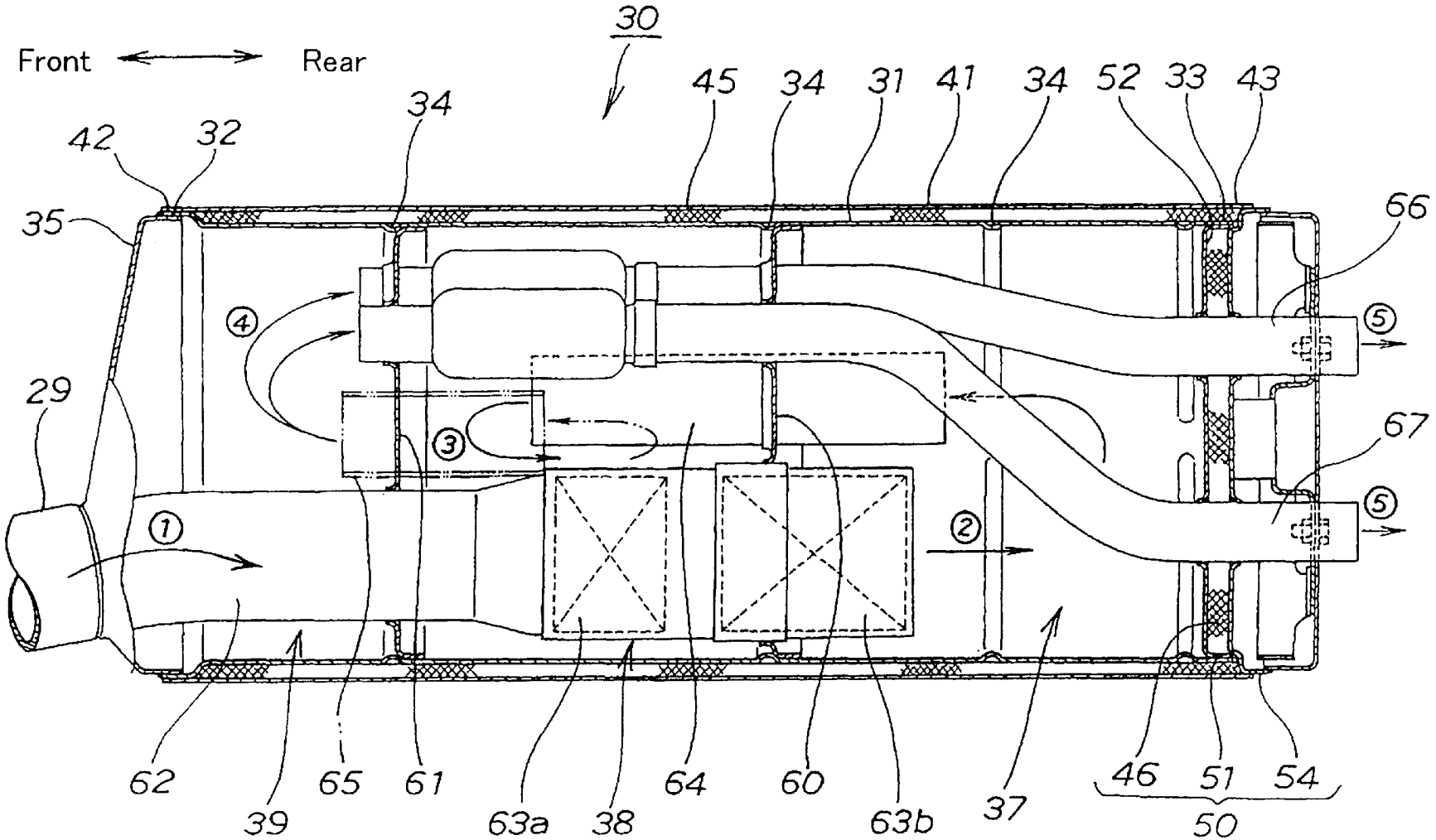
FIG. 2 is a cross sectional view illustrating the exhaust silencer of FIG. 1.

FIG. 2 shows a sectional view illustrating an exhaust silencer according to the present invention. The exhaust silencer 30 is provided with a first, a second, and a third expansion chambers 37, 38, and 39 in order from a rear end side toward a front end side. The first, second and third expansion chambers 37, 38, and 39 are disposed inside an inner cylinder 31.

One end portion (front end portion) 32 of the inner cylinder 31 is welded and coupled to a front lid 35. One end portion (front end portion) 42 of an outer cylinder 41 is welded and coupled to the front lid 35. A damping material, such as glass wool 45, is sandwiched between the outer cylinder 41 and the inner cylinder 31.

The other end portion (rear end portion) 43 of the outer cylinder 41 is blocked with a stepped disc 50. The other end portion (rear end portion) 33 of the inner cylinder 31 is slidably fitted on a step portion 51 of this stepped disc 50.

The outer cylinder 41 is a cylindrical body formed in an elliptic shape. The inner cylinder 31 is formed in the elliptic shape to have a constant clearance between the inner cylinder 31 and the outer cylinder 41. Further the inner cylinder 31 is a cylindrical body formed with plural recesses 34 for reinforcement at prescribed intervals.

The stepped disc 50 includes a plate member, such as an enlarged diameter portion 54 of an elliptic shape fittably formed in the rear end portion 43 of the outer cylinder 41. The step portion 51 of the elliptic shape is slidably and fittably formed in the rear end portion 33 of the inner cylinder 31, and glass wool 46 is stored in a portion 52 inside the step portion 51.

As mentioned above, since the stepped disc 50 is divided into the step portion 51 and the enlarged diameter portion 54, the glass wool 46 can be stored in the stepped disc 50. Accordingly, a noise damping effect of the exhaust silencer 30 is improved. FIG. 2 also illustrates a first bulkhead 60 and a second bulkhead 61.

In the exhaust silencer 30, the exhaust gas from the engine 16 (illustrated in FIG. 1) is introduced from an exhaust pipe 29 into an inlet pipe 62, as shown by an arrow mark (1). Exhaust gas flowing into the inlet pipe 62 is introduced into the first expansion chamber 37 through catalysts 63*a* and 63*b*, as shown by an arrow mark (2). The exhaust gas is introduced into the second expansion chamber 38 through a first communicating tube 64, as shown by an arrow mark (3). The exhaust gas flowing into the second expansion chamber 38 is introduced into the third expansion chamber 39 through a second communicating tube 65 as shown by an arrow mark (4). Finally, the exhaust gas of the third expansion chamber 39 is discharged to the outside of the exhaust silencer 30 through tale pipes 66 and 67, as shown by an arrow mark (5).

Figure 3:
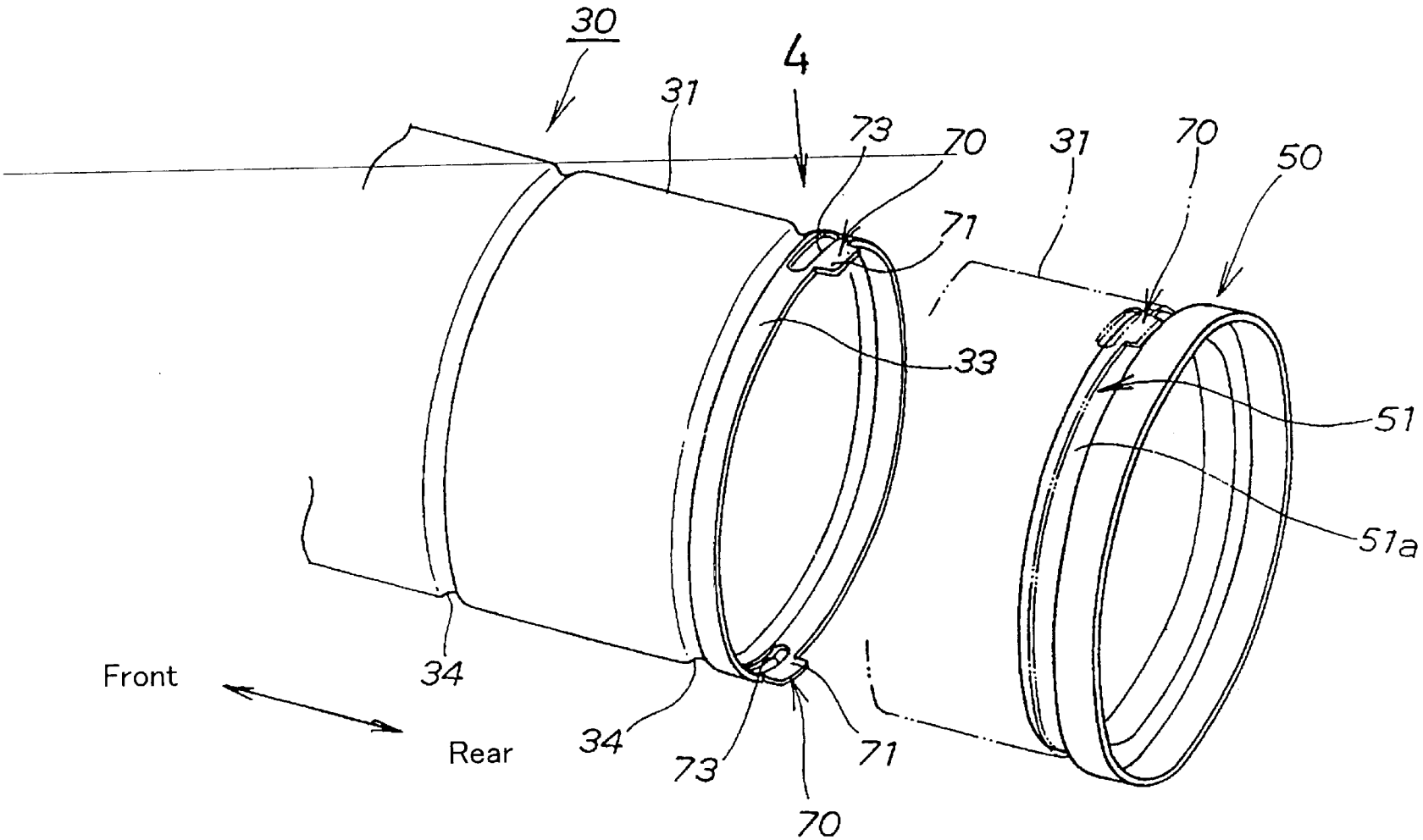
FIG. 3 is an exploded perspective view illustrating a portion of the exhaust silencer.

FIG. 3 shows an exploded perspective view illustrating a portion of an exhaust silencer, according to the present invention. FIG. 3 illustrates the rear end portion 33 of the inner cylinder 31 and the stepped disc 50.

The inner cylinder 31 has the form of a cylindrical body of an elliptic shape. The inner cylinder 31 is provided with a pair of fuse portions 70, 70 on an longitudinal axis of the rear end portion 33. The pair of fuse portions 70, 70 are welded to the step portion 51 (outer periphery 51*a* of step portion 51) in a state where the rear end portion 33 of the inner cylinder 31 is slidably fitted on the step portion 51 of the stepped disc 50. Thus, the step portion 51 of the stepped disc 50 can be tacked temporarily to the inner cylinder 31 in a temporary assembly stage.

Figure 4:
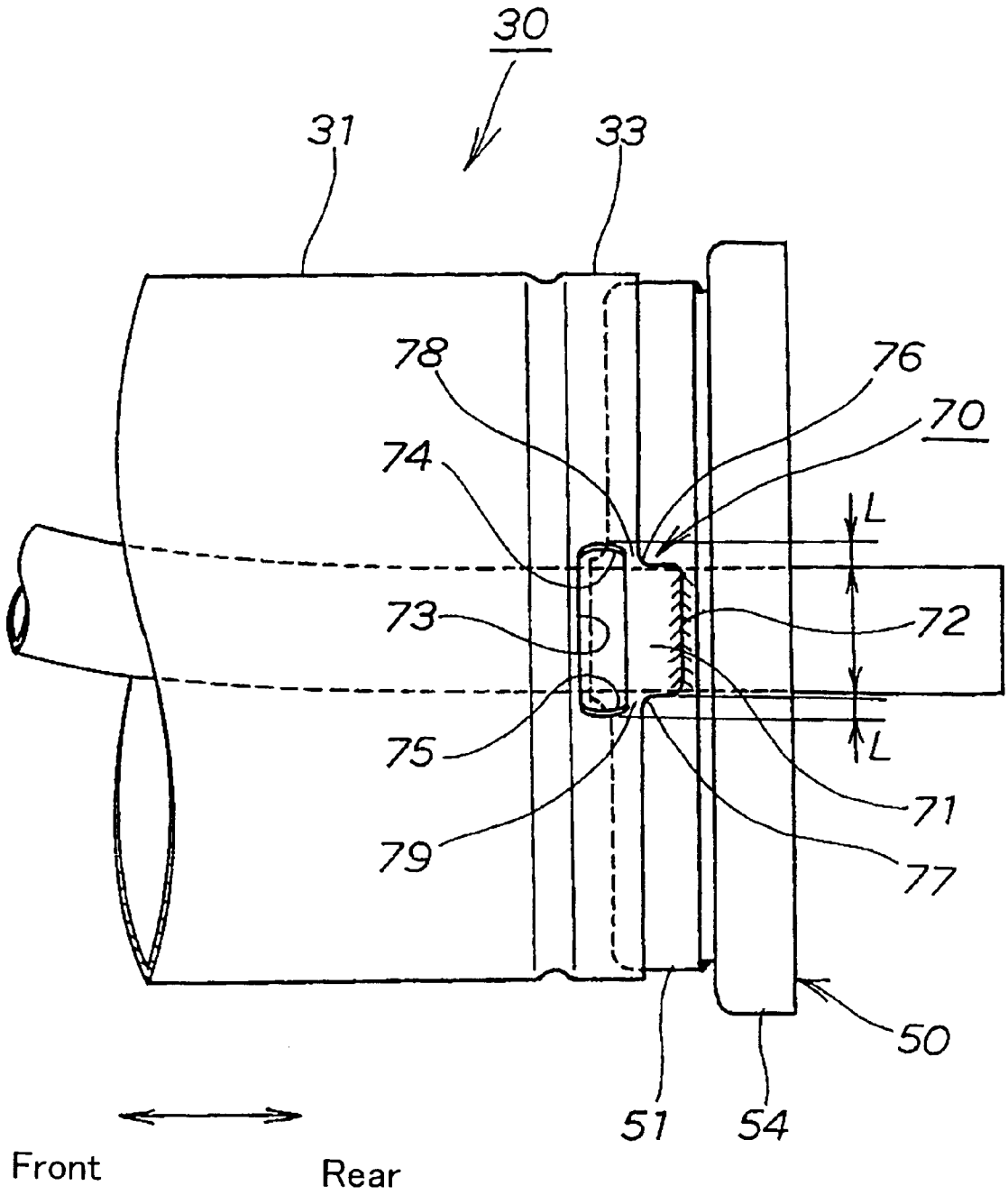
FIG. 4 is a plan view illustrating the portion of the exhaust silencer.

FIG. 4 shows a plan view illustrating a portion of an exhaust silencer according to the present invention. FIG. 4 illustrates the rear end portion 33 of the inner cylinder 31 and the stepped disc 50.

In the fuse portion 70, a protruding piece 71 is formed at the rear end portion 33 of the inner cylinder 31. A substantially rectangular opening 73 is formed forward of the protruding piece 71. A tip portion 72 of the protruding piece 71 is welded to the outer periphery 51*a* of the step portion 51 of the stepped disc 50.

Fracture portions 78, 79 are formed by stretching out both ends 74, 75 of the opening 73 by respectively distances L and L to both sides of the protruding piece 71. By protruding the protruding piece 71 from the rear end portion 33 of the inner cylinder 31, corner portions 76, 77 are formed between the protruding piece 71 and the rear end portion 33. Thus, stress is likely to concentrate on the corner portions 76, 77 and the fracture portions 78, 79 can be surely fractured.

Figure 5:
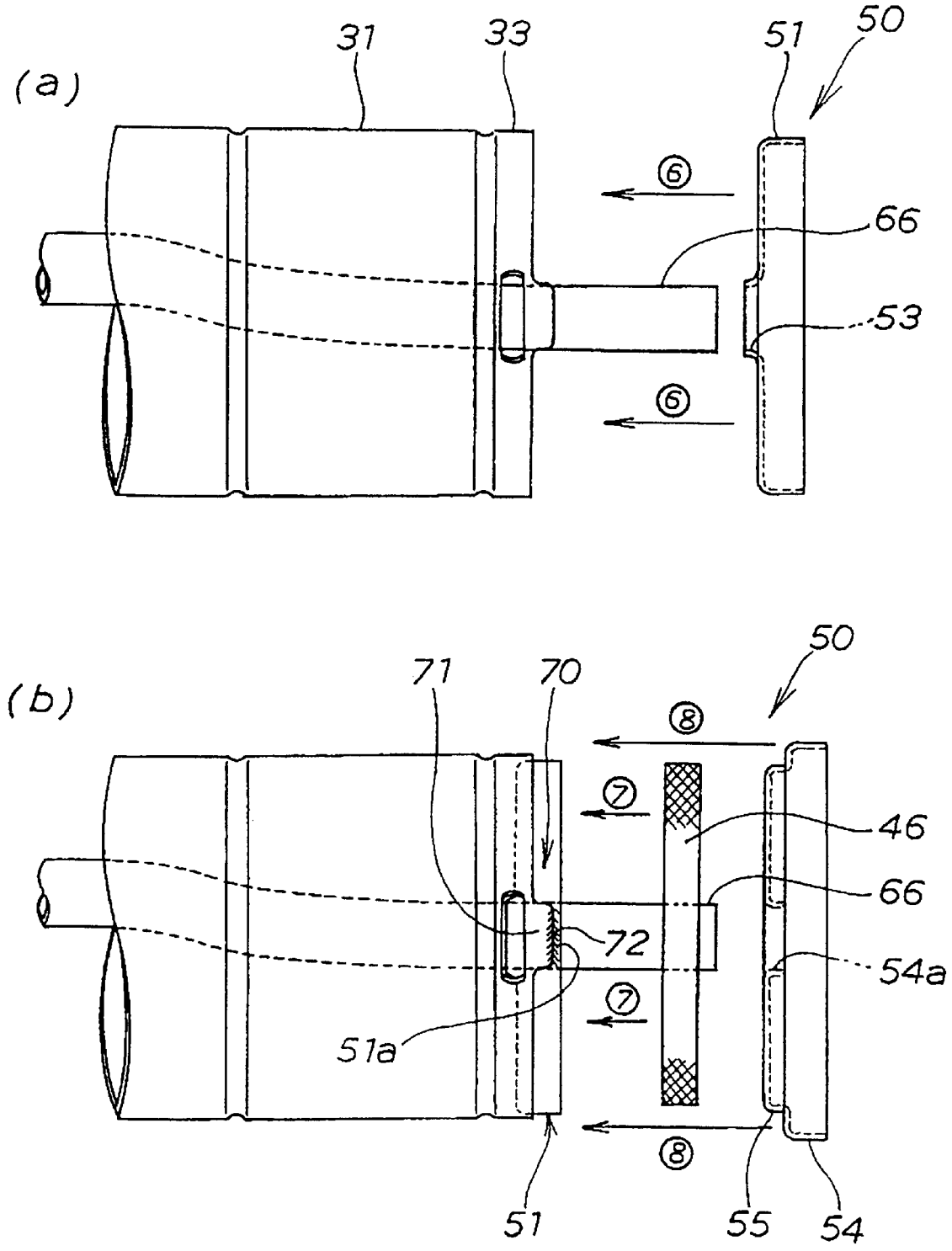
FIGS. 5(*a*) and 5(*b*) are explanatory views illustrating an assembly procedure for the exhaust silencer.

Next, an assembly procedure of the exhaust silencer 30 will be explained. FIG. 5(*a*) and FIG. 5(*b*) are first explanatory views illustrating an assembly procedure of an exhaust silencer, according to the present invention.

In FIG. 5(*a*), a step portion 51 is fitted in the rear end portion 33 of the inner cylinder 31, as shown by an arrow mark (6). Simultaneously, a fitting hole 53 of the step portion 51 is fitted on the tale pipe 66.

In FIG. 5(*b*), the tip portion 72 of the protruding piece 71 constituting the fuse portion 70 is welded to the outer periphery 51*a* of the step portion 51. In the temporary assembly stage, the step portion 51 can be tacked temporarily to the inner cylinder 31. Accordingly, assembly work of following processes is simplified to save trouble.

Next, the glass wool 46 is stored in the step portion 51 as shown by an arrow mark (7). Next, a fitting portion 55 of the enlarged diameter portion 54 is fitted in the step portion 51 as shown by an arrow mark (8). Simultaneously, a fitting hole 54*a* of the enlarged diameter portion 54 is fitted on the tale pipe 66.

Figure 6:
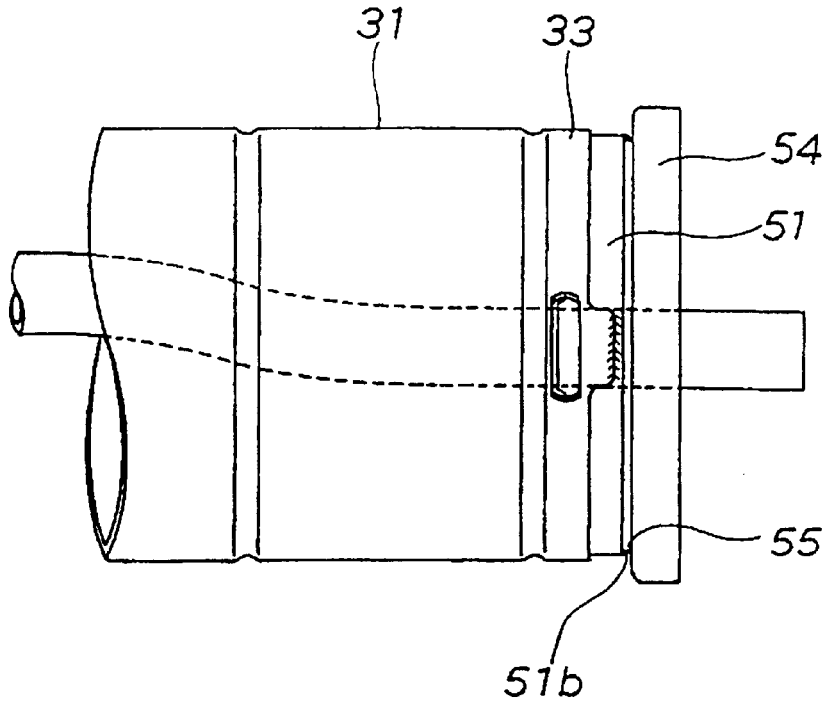
FIGS. 6(*a*) and 6(*b*) are a second explanatory views further illustrating the assembly procedure for the exhaust silencer.
Figure 6:
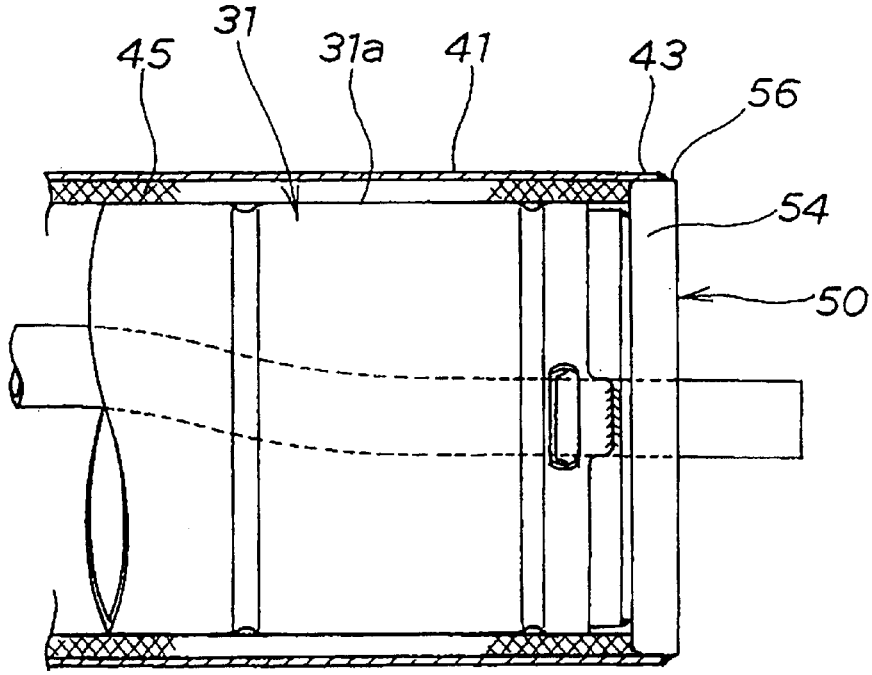

FIG. 6(*a*) and FIG. 6(*b*) are second explanatory views further illustrating the assembly procedure of the exhaust silencer, according to the present invention. In FIG. 6(*a*), a rear end portion 51*b* of the step portion 51 is welded and fixed to the fitting portion 55 of the enlarged diameter portion 54. The two welding positions are preferable at 180° intervals, however, the welding place is not limited to this, for example circumferential welding may be applied.

As illustrated in FIG. 5(*b*), the step portion 51 is tacked temporarily to the inner cylinder 31 in the temporary assembly stage. Therefore, when the enlarged diameter portion 54 is welded to the step portion 51, the step portion 51 is not deviated from a regular location at all. Thus, the enlarged diameter portion 54 can simply be welded with little trouble to the step portion 51.

In FIG. 6(*b*), the glass wool 45 is mounted on the outer periphery 31*a* of the inner cylinder 31, and this glass wool 45 is sandwiched between the inner cylinder 31 and the outer cylinder 41 by covering the glass wool 45 with the outer cylinder 41. Simultaneously, the enlarged diameter portion 54 is fitted in the rear end portion 43 of the outer cylinder 41. The rear end portion 43 of the outer cylinder 41 is circumferentially welded to the outer periphery 56 of the enlarged diameter portion 54. Thus, the outer cylinder 41 is fixed to the enlarged diameter portion 54.

Since the stepped disc 50 is tacked temporarily to the inner cylinder 31, the stepped disc 50 is prevented from deviating from the regular location. Thus, the rear end portion 43 of the outer cylinder 41 can simply be welded with little effort to the outer periphery 56 of the enlarged diameter portion 54.

Figure 7:
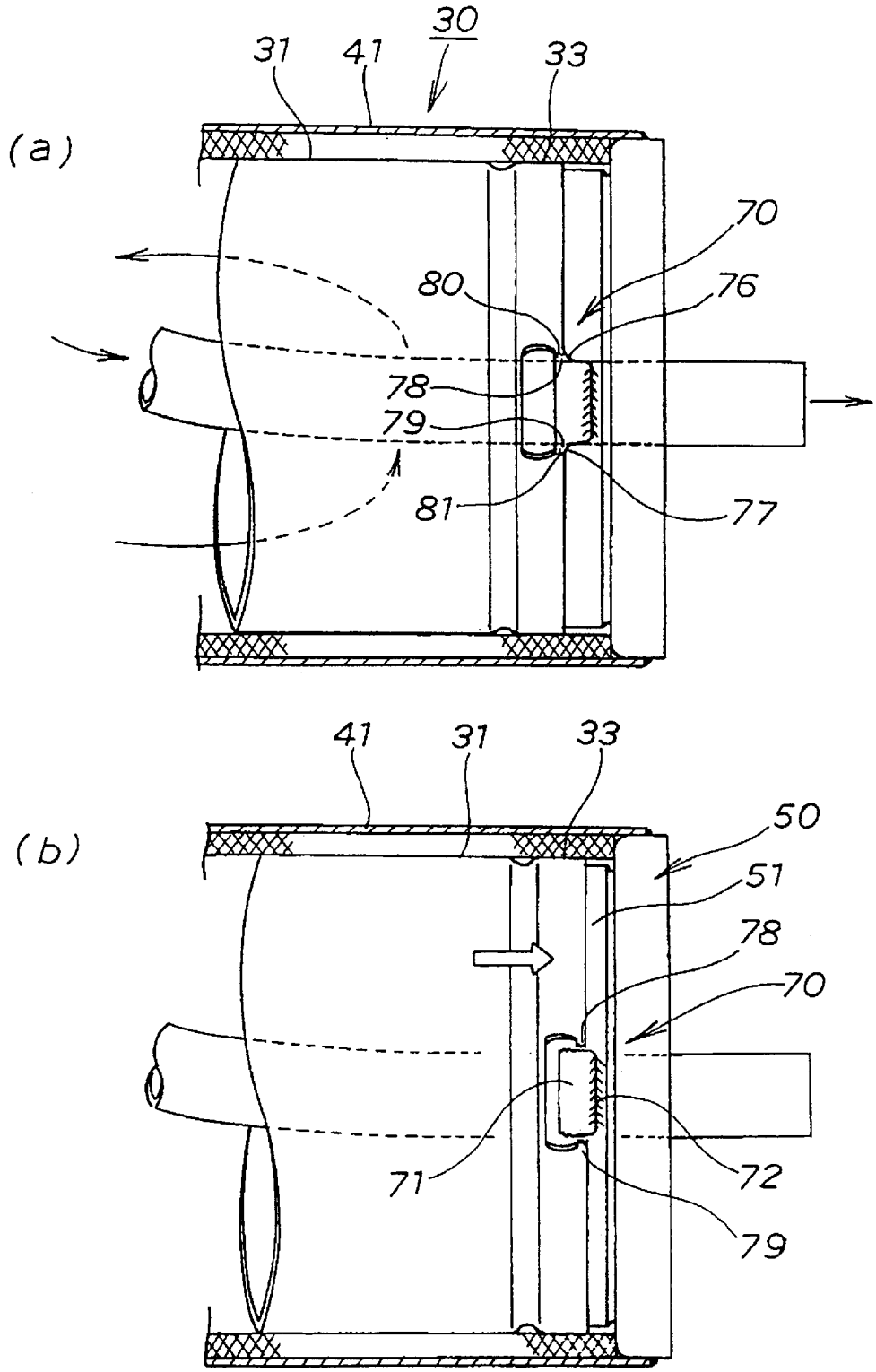
FIGS. 7(*a*) and 7(*b*) are explanatory views illustrating an operation of the exhaust silencer.

Next, an operation of an exhaust silencer will be explained. FIG. 7(*a*) and FIG. 7(*b*) are explanatory views illustrating an operation of an exhaust silencer according to the present invention. In FIG. 7(*a*), by flowing exhaust gas into the exhaust silencer 30, as shown by an arrow mark, the inner cylinder 31 and the outer cylinder 41 are thermally expanded. In this case, since the outer cylinder 41 is brought into contact with atmospheric air, a temperature thereof is lowered compared with that of the inner cylinder 31. Therefore, the elongation of the inner cylinder 31 is larger than the elongation of the outer cylinder 41.

Here, the front end portion 32 of the inner cylinder 31 is welded (illustrated in FIG. 1) to the front lid 35. Further, the rear end portion 33 of the inner cylinder 31 is welded to the step portion 51 of the stepped disc 50. Therefore, when the inner cylinder 31 is thermally expanded, stress is concentrated on the corner portions 76, 77 of the fuse portions 70 and cracks 80 and 81 are generated at the fracture portions 78, 79.

In FIG. 7(*b*), the fracture portions 78, 79 of the fuse portion 70 are fractured and the rear end portion 33 of the inner cylinder 31 is separated from the stepped disc 50. Thus, the rear end portion 33 of the inner cylinder 31 is slid, as shown by a white arrow mark, relative to the step portion 51 of the stepped disc 50.

The relative elongation of the inner cylinder 31 to the outer cylinder 41 is permitted by sliding the rear end portion 33 of the inner cylinder 31.

Figure 8:
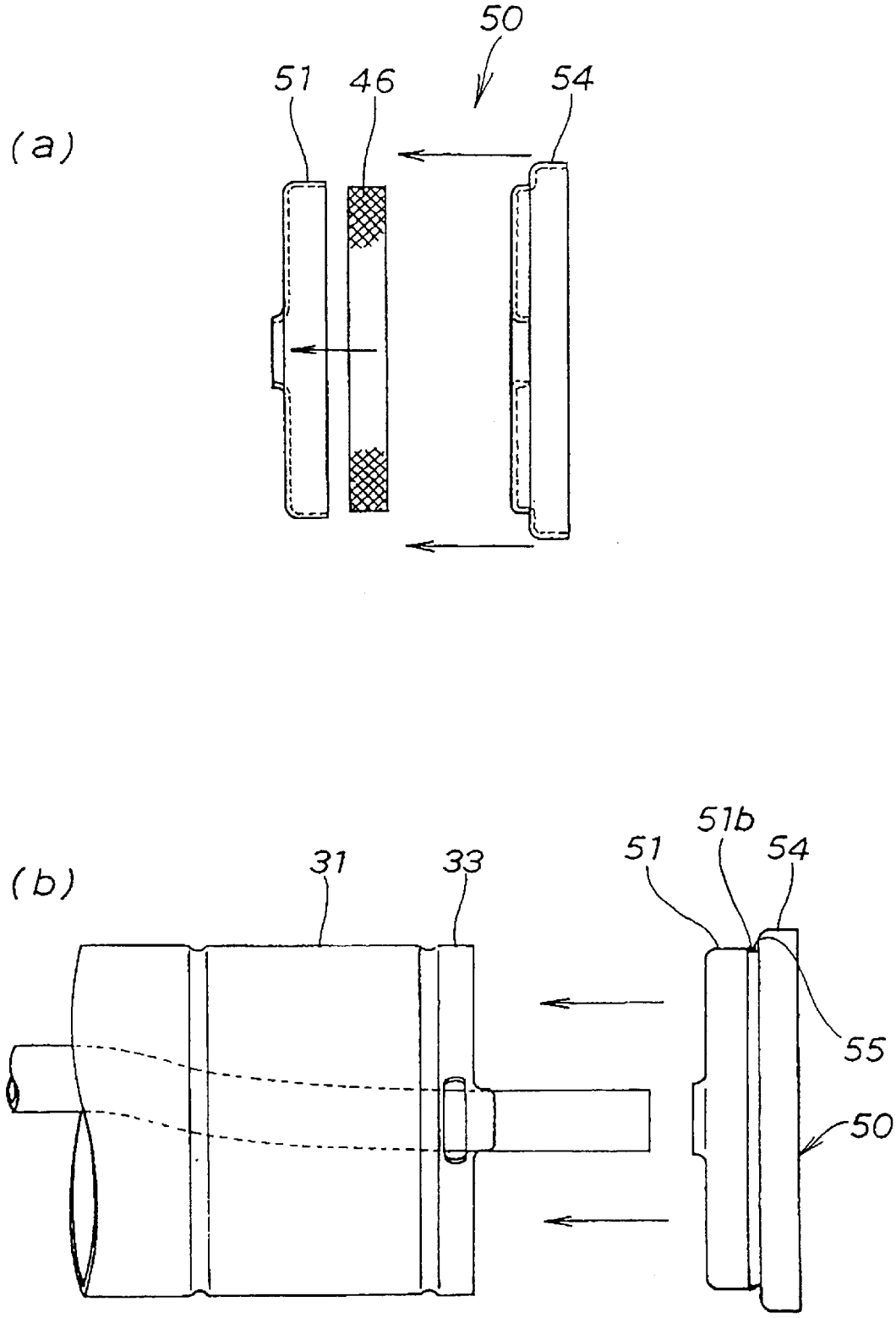
FIGS. 8(*a*) and 8(*b*) are first explanatory views illustrating an alternative assembly procedure of the exhaust silencer.

Next, the an alternative assembly procedure of the exhaust silencer 30 will be explained. FIG. 8(*a*) and FIG. 8(*b*) are first explanatory views illustrating the other assembly procedure of an exhaust silencer according to the present invention. In FIG. 8(*a*), after the glass wool 46 is stored in the step portion 51 of the stepped disc 50, the enlarged diameter portion 54 is fitted in the step portion 51.

In FIG. 8(*b*), the stepped disc 50 is integrally assembled with each other by welding the rear end portion 51*b* of the step portion 51 to the fitting portion 55 of the enlarged diameter portion 54. Next, the step portion 51 of the stepped disc 50 is fitted in the rear end portion 33 of the inner cylinder 31.

Figure 9:
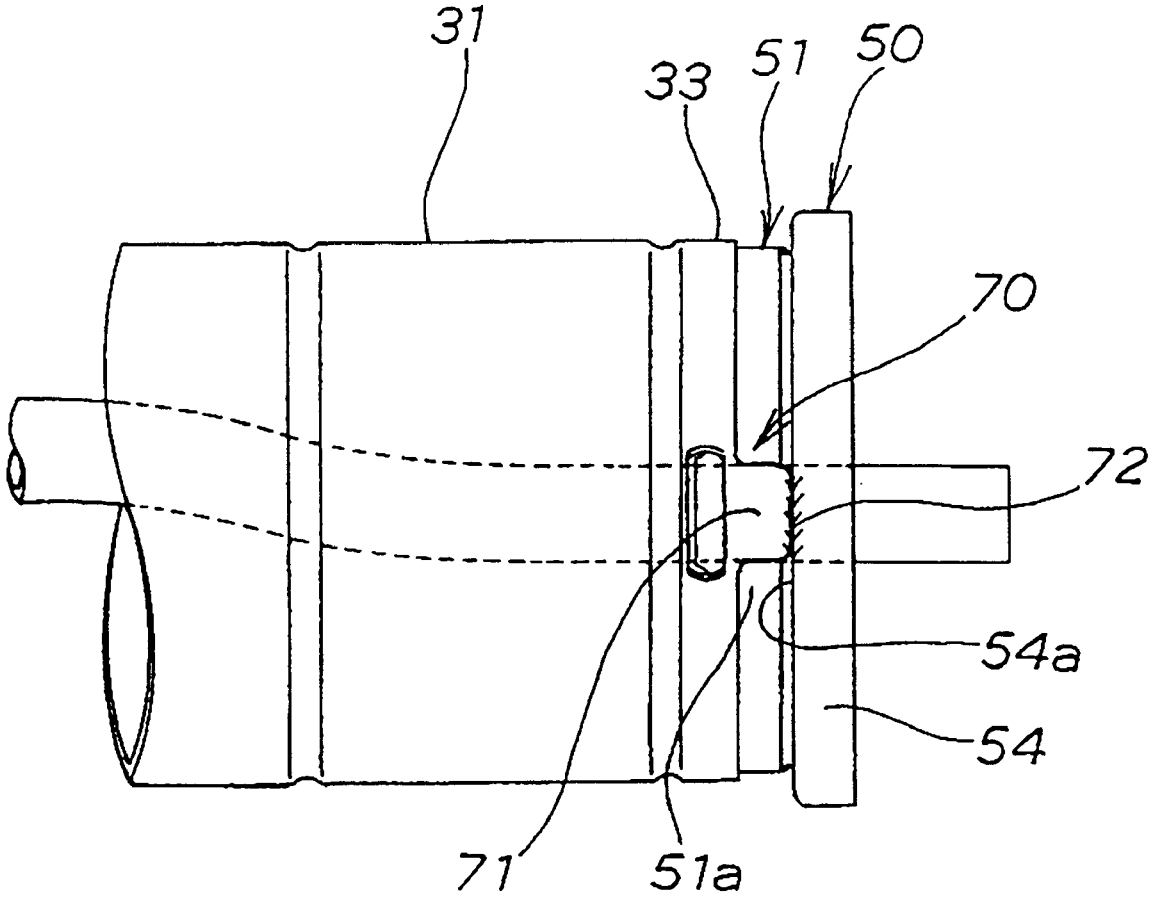
FIG. 9 is a second explanatory view further illustrating the alternative assembly procedure of the exhaust silencer.

FIG. 9 is a second explanatory view further illustrating the other assembly procedure of the exhaust silencer, according to the present invention. A tip portion 72 of the protruding piece 71 constituting the fuse portion 70 is bumped against a wall surface 54*a* (that is, a wall surface forming the step portion) of the enlarged diameter portion 54. Next, the tip portion 72 of the protruding piece 71 is welded to the wall surface 54*a* of the enlarged diameter portion 54.

Thus, in the temporary assembly stage, the stepped disc 50 can be tacked temporarily to the inner cylinder 31. In other words, the tip portion 72 of the protruding piece 71 can be welded to the outer periphery 51*a* of the step portion 51 in place of being welded to the wall surface 54*a* of the enlarged diameter portion 54.

Returning to FIG. 6(*b*), the glass wool 45 and the outer cylinder 41 are mounted on the outside of the inner cylinder 31. In this case, since the stepped disc 50 is tacked temporarily to the inner cylinder 31, when welding the outer cylinder 41 to the outer periphery 56 of the enlarged diameter portion 54, the stepped disc can be prevented from deviating from the regular location. Therefore, the rear end portion 43 of the outer cylinder 41 can simply be welded with little trouble to the outer periphery 56 of the enlarged diameter portion 54.

The above disclosure sets forth an example of adopting the exhaust silencer 30 of the present invention for the motorcycle 10. However, the exhaust silencer 30 can be adopted, for example, for a three-wheeled vehicle or an automobile.

Further, the present invention describes an example of providing the fuse portion 70 at the rear end portion 33 of the inner cylinder 31. However, even if the fuse portion 70 is provided at the front end portion of the inner cylinder, the same effect as that of the example can be obtained.

In the fuse portion 70, a notch may be formed at the corner portion. By forming the notch, the fracture portion can be further assured of fracturing. Further, the opening 73 of the fuse portion 70 is illustrated as being formed substantially in a rectangular shape. However, the shape of the opening 73 be varied to other shapes.

The present invention discloses a pair of the fuse portions 70, 70 at the rear end portion 33 of the inner cylinder 31. However, the number of fuse portions can be set to one, three or more.

Additionally, regarding the fuse portion 70, the present invention describes an example of welding the tip portion 72 of the protruding piece 71 to the step portion (outer periphery 51*a* of step portion 51 or wall surface 54*a* of enlarged diameter portion 54) of the stepped disc 50. However, both side edges of the tip portion 72 maybe welded to the outer periphery 51*a* of the step portion 51.

The present invention exhibits many advantages over the background art. For example, a fuse portion is formed to tack temporarily a stepped disc to an inner cylinder by welding the fuse portion to a step portion of the stepped disc or to a wall surface constituting the step portion. When performing assembly work, such as when the stepped disc is welded to a rear end portion of an outer cylinder, the stepped disc is prevented from deviating from a regular location. Accordingly, an assembly process of the exhaust silencer is simplified to save time and trouble.

Further, when thermal expansion occurs with the inner cylinder, the fuse portion is constructed to separate the inner cylinder from the stepped disc by fracturing of the fuse portion. Therefore, a rear end portion of the inner cylinder is slid relative to the step portion of the stepped disc, and relative elongation of the inner cylinder to the outer cylinder is permitted.

In the above description, the terms "front" and "rear" are directions, as viewed from a driver's perspective, or a normal travel direction of the motorcycle or vehicle.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A muffler comprising:

an inner cylinder having a first end and a second end;

an outer cylinder having a first end and a second end, wherein said first end of said inner cylinder is fixed to said first end of said outer cylinder;

a stepped disc fixed to said second end of said outer cylinder, said stepped disc including a step portion engaging said second end of said inner cylinder; and at least one fuse portion tacking said second end of said inner cylinder to said step portion or a wall surface of said stepped disc, wherein said fuse portion is structured to break when said inner cylinder becomes elongated relative to said outer cylinder due to heat expansion.

2. The muffler according to claim 1, wherein said inner cylinder includes a plurality of expansion chambers for accommodating exhaust gases.

3. The muffler according to claim 1, further comprising a damping material sandwiched between said outer cylinder and said inner cylinder.

4. The muffler according to claim 3, wherein said damping material is glass wool.

5. The muffler according to claim 1, wherein said outer cylinder has an elliptical cross sectional shape.

6. The muffler according to claim 5, wherein said inner cylinder has an elliptical cross sectional shape.

7. The muffler according to claim 6, wherein said elliptical cross sectional shape of said inner cylinder is geometrically similar to said elliptical cross sectional shape of said outer cylinder, such that substantially an equal distance spacing is maintained between said inner cylinder and said outer cylinder.

8. The muffler according to claim 2, further comprising a damping material sandwiched between said outer cylinder and said inner cylinder.

9. The muffler according to claim 8, wherein said damping material is glass wool.

10. The muffler according to claim 2, wherein said outer cylinder has an elliptical cross sectional shape.

11. The muffler according to claim 10, wherein said inner cylinder has an elliptical cross sectional shape.

12. The muffler according to claim 11, wherein said elliptical cross sectional shape of said inner cylinder is geometrically similar to said elliptical cross sectional shape of said outer cylinder, such that substantially an equal distance spacing is maintained between said inner cylinder and said outer cylinder.

13. A method of forming a muffler comprising the steps of:

providing an inner cylinder having a first end and a second end, and an outer cylinder having a first end and a second end;

attaching the first end of the inner cylinder to the first end of the outer cylinder;

temporarily tacking the second end of the inner cylinder to a step portion or a wall surface of a stepped disc;

placing a damping material adjacent to a surface of the stepped disc opposite the inner cylinder;

placing a plate member adjacent to a surface of the damping material opposite the stepped disc; and fixing the plate member to the outer cylinder.

14. The method according to claim 13, further comprising the steps of:

passing a heated gas through the inner cylinder, causing an elongation of the inner cylinder relative to the outer cylinder;

breaking the temporary tacking of the second end of the inner cylinder to the step portion or wall surface of the stepped disc; and thereafter accommodating relative thermal expansion of the inner cylinder relative to the outer cylinder by sliding the second end of the inner cylinder on the step portion of the stepped disc.

15. The method according to claim 13, wherein said steps of attaching, temporarily tacking and fixing including welding.

16. The method according to claim 13, wherein said step of temporarily tacking the second end of the inner cylinder to a step portion or wall surface of a stepped disc includes:

providing a fuse portion extending from the second end of the inner cylinder; and welding a part of the fuse portion to the step portion or wall surface of the stepped disc.

17. A method of forming a muffler comprising the steps of:

providing an inner cylinder having a first end and a second end, and an outer cylinder having a first end and a second end;

attaching the first end of the inner cylinder to the first end of the outer cylinder;

providing a stepped disc having a step portion;

placing a damping material adjacent to a surface of the stepped disc opposite the step portion;

placing a plate member adjacent to a surface of the damping material opposite the stepped disc;

connecting the plate member to the stepped disc so as to sandwich the damping material therebetween;

abutting the step portion to the second end of the inner cylinder;

temporarily tacking the second end of the inner cylinder to the step portion or a wall surface of the stepped disc; and fixing the plate member to the outer cylinder.

18. The method according to claim 17, further comprising the steps of:

passing a heated gas through the inner cylinder, causing an elongation of the inner cylinder relative to the outer cylinder;

breaking the temporary tacking of the second end of the inner cylinder to the step portion or wall surface of the stepped disc; and thereafter accommodating relative thermal expansion of the inner cylinder relative to the outer cylinder by sliding the second end of the inner cylinder on the step portion of the stepped disc.

19. The method according to claim 17, wherein said steps of attaching, connecting, temporarily tacking and fixing including welding.

20. The method according to claim 17, wherein said step of temporarily tacking the second end of the inner cylinder to a step portion or wall surface of a stepped disc includes:

providing a fuse portion extending from the second end of the inner cylinder; and welding a part of the fuse portion to the step portion or wall surface of the stepped disc.

* * * * *